US007367067B2

(12) United States Patent
Watanabe et al.

(10) Patent No.: US 7,367,067 B2
(45) Date of Patent: May 6, 2008

(54) WARM BATH APPARATUS

(75) Inventors: Shunichi Watanabe, Hikone (JP); Shigenori Kugumiya, Hikone (JP); Shingo Ohmura, Hikone (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 191 days.

(21) Appl. No.: 10/859,180

(22) Filed: Jun. 3, 2004

(65) Prior Publication Data

US 2005/0015874 A1 Jan. 27, 2005

(30) Foreign Application Priority Data

Jun. 4, 2003 (JP) ..... 2003-160011

(51) Int. Cl.
*E03C 1/00* (2006.01)

(52) U.S. Cl. ..... 4/622

(58) Field of Classification Search ..... 4/535, 4/622, 524; 601/17

See application file for complete search history.

(56) References Cited

U.S. PATENT DOCUMENTS

| | | | | |
|---|---|---|---|---|
| 1,754,971 | A * | 4/1930 | Waigand | 604/23 |
| 4,497,313 | A | 2/1985 | Kurosawa | |
| 4,833,739 | A * | 5/1989 | Sakakibara et al. | 4/524 |
| 5,136,734 | A * | 8/1992 | Yli-Kovero | 4/524 |
| 6,363,548 | B1 | 4/2002 | Kuo | |
| 2003/0220593 | A1 | 11/2003 | Morton | |

FOREIGN PATENT DOCUMENTS

| | | |
|---|---|---|
| EP | 121500 | * 10/1984 |
| EP | 1 068 849 | 1/2001 |
| JP | 5-212088 | 8/1993 |
| JP | 11-89909 | 4/1999 |
| JP | 2000-51376 | 2/2000 |
| JP | 2001-120636 | 5/2001 |
| JP | 2002-143267 | 5/2002 |

* cited by examiner

*Primary Examiner*—Charles E. Phillips
(74) *Attorney, Agent, or Firm*—Oblon, Spivak, McClelland, Maier & Neustadt, P.C.

(57) ABSTRACT

A warm bath apparatus for safely and comfortably warming a part of a user's body such as feet and hands by use of a previously prepared mixture of air and heated liquid particles such as steam is provided. This apparatus comprises a housing having a warm bath room, a tank for storing a liquid, a heater for heating the liquid to provide heated liquid particles, a mixing room separately formed from the warm bath room in the housing to mix the heated liquid particles with air; and a supply port for supplying a resultant mixture of the heated liquid particle and the air provided from the mixing room into the warm bath room According to this apparatus, it is possible to provide a warm bath therapy effect to the user suffering from sensitivity to cold with a high degree of satisfaction.

8 Claims, 5 Drawing Sheets

WARM BATH APPARATUS

BACKGROUND OF THE INVENTION

1. Field of the Invention

The present invention relates to a warm bath apparatus for warming a part of a living body such as feet and hands by use of heated liquid particles such as steam.

2. Disclosure of the Prior Art

In recent years, living environments fully equipped for air-conditioning and heating or excessive dieting lead to lessening the function of regulating body temperature, so that people suffering from sensitivity to cold are increasing. Since it is thought that the sensitivity to cold is caused by bad circulation of blood, facilitating the flow of blood by bathing or exercising is effective for the people suffering from the sensitivity to cold.

For example, Japanese Patent Early Publication No. 11-89909 discloses a foot bath apparatus for bathing a user's feet in hot water. This apparatus 100, as shown in FIG. 11, comprises a bath vessel 110 having a top opening, heater 120 for heating water in the bath vessel and a cover 130 having a projection 131 on its bottom. After a suitable amount of water is put in the bath vessel 110, in which the user's feet are placed, the water in the bath vessel is heated at a desired bathing temperature by the heater 120 to provide a warm bath therapy effect to the user. In addition, when the top opening of the bath vessel 110 is closed by the cover 130, the projection 131 of the cover is partially put in the water in the bath vessel to raise a water level in the bath vessel. Thereby, the user's feet can be warmed over a wide range by use of a reduced amount of water. However, operations for discharging the used water from the foot bath apparatus and exchanging the used water with fresh water are still troublesome. In addition, there is a problem that it takes a relatively long time to heat the water in the bath vessel at the bathing temperature.

On the other hand, Japanese Patent Early Publication No. 2000-51376 discloses a foot bath apparatus 200 using far-infrared ray in the presence of steam. As shown in FIG. 12, this apparatus 200 comprises a housing 210 having a foot bath room 212 therein, far-infrared lamp 220, fan 230 and a steam generator 240, which are disposed in the foot bath room. After a user's feet are inserted into the foot bath room 212 through an opening 214 formed in the housing, infrared ray is irradiated to the user's feet in the presence of steam generated by the steam generator 240. In this apparatus, since steam is used as a bathing medium, it is possible to remarkably reduce the amount of water to be supplied into the foot bath apparatus 200. However, it is needed to space the steam generator 240 from the user's feet in the foot bath room 212 to prevent burn injury. This leads to an increase in size of the foot bath apparatus. In addition, since steam supplied from the steam generator 240 is diffused into the foot bath room 212 along the air flow provided by the fan 230, a variation in distribution of the steam particles occurs in the foot bath room 212. This prevents uniformly warming the user's feet and deteriorates the degree of satisfaction of the user.

Thus, conventional warm bath apparatuses still leave much to be improved from the viewpoints of downsizing the apparatus and providing a uniform warm bath effect to the user.

SUMMARY OF THE INVENTION

Therefore, a primary concern of the present invention is to provide a compact warm bath apparatus having the capability of safely providing a uniform warm bath effect to a user, and particularly people suffering from sensitivity to cold with a high degree of satisfaction.

That is, the warm bath apparatus of the present invention comprises a housing having a warm bath room for accommodating a part of a living body; a tank for storing a liquid; a heater for heating the liquid to provide heated liquid particles; a mixing room separately formed from the warm bath room in the housing to mix the heated liquid particles with air; and a supply port for supplying a resultant mixture of the heated liquid particle and the air provided from the mixing room into the warm bath room.

In the warm bath apparatus of the present invention, after heated liquid particles such as steam generated by the heater are previously mixed with a required amount of the air in the mixing room, the resultant mixture is supplied as a bathing medium to the warm bath room. Therefore, it is possible to remarkably decrease a variation in distribution of the heated liquid particles in the warm bath room and uniformly warm the part of the living body, as compared with a conventional case of diffusing steam particles by use of a fan disposed in a warm bath room. In addition, since the steam particles of a high temperature are not directly supplied into the warm bath room, it is possible to prevent burn injury and effectively reduce the internal volume of the warm bath room. In other words, the heated liquid particles are suitably cooled by previously mixing with the air, so that the resultant mixture of a desired temperature can be supplied as the bathing medium into the warm bath room. Thus, according to the present invention, the warm bath apparatus can be designed in compact size to safely provide a warm bath therapy effect to the user with a high degree of satisfaction.

It is preferred that the above warm bath apparatus further comprises an air intake channel for supplying the air in the warm bath room into the mixing room. In this case, the air in the warm bath room is supplied into the mixing room through the air intake channel, and then mixed with the heated liquid particles, so that the resultant mixture is supplied into the warm bath room thorough the supply port. Since the part of the living body is warmed by the mixture in the warm bath room, a part of heat of the mixture is lost. However, the used mixture is sufficiently higher in temperature than the air outside the warm bath apparatus. Therefore, when the used mixture is sent to the mixing room through the air intake channel, and then mixed with the heated liquid particles provided through the liquid-particle intake channel in the mixing room, it is possible to save amounts of the heated liquid particles needed to reproduce the mixture to be supplied into the warm bath room. Thus, the formation of the air intake channel for recycling the used mixture is effective to present the warm bath apparatus of energy-saving type.

It is also preferred that the above warm bath apparatus further comprises suction means such as a fan for sucking the air in the warm bath room into the air intake channel. In this case, it is possible to stably supply the air into the mixing room. In addition, there is an advantage that a mixture ratio of the air and the heated liquid particles can be changed by controlling the fan.

It is also preferred that the above warm bath apparatus further comprises a liquid-particle intake channel for supplying the heated liquid particles generated by the heater to the mixing room, a converging portion for joining the liquid-particle intake channel with the air intake channel, and a single fan disposed in the converging portion to simultaneously supply both of the air provided from the air intake channel and the heated liquid particles provided from the liquid-particle intake channel into the mixing room. This case is particularly suitable to realize a compact warm bath apparatus excellent in energy-saving performance.

In addition, it is preferred that the warm bath room is configured to accommodate a foot of a user, and the mixture is supplied to a sole of the user's foot accommodated in the warm bath room through the supply port. In particular, it is preferred that a footplate is disposed in the warm bath room, and formed with a plurality of apertures in its top surface, through which the mixture is supplied to the sole of the user's foot on the footplate.

Other features and advantages of the present invention will be clearly understood from the detail description of the present invention described below, referring to the attached drawings.

DETAIL DESCRIPTION OF THE INVENTION

As a preferred embodiment of a warm bath apparatus of the present invention, a foot bath apparatus is explained below.

Figure 1:
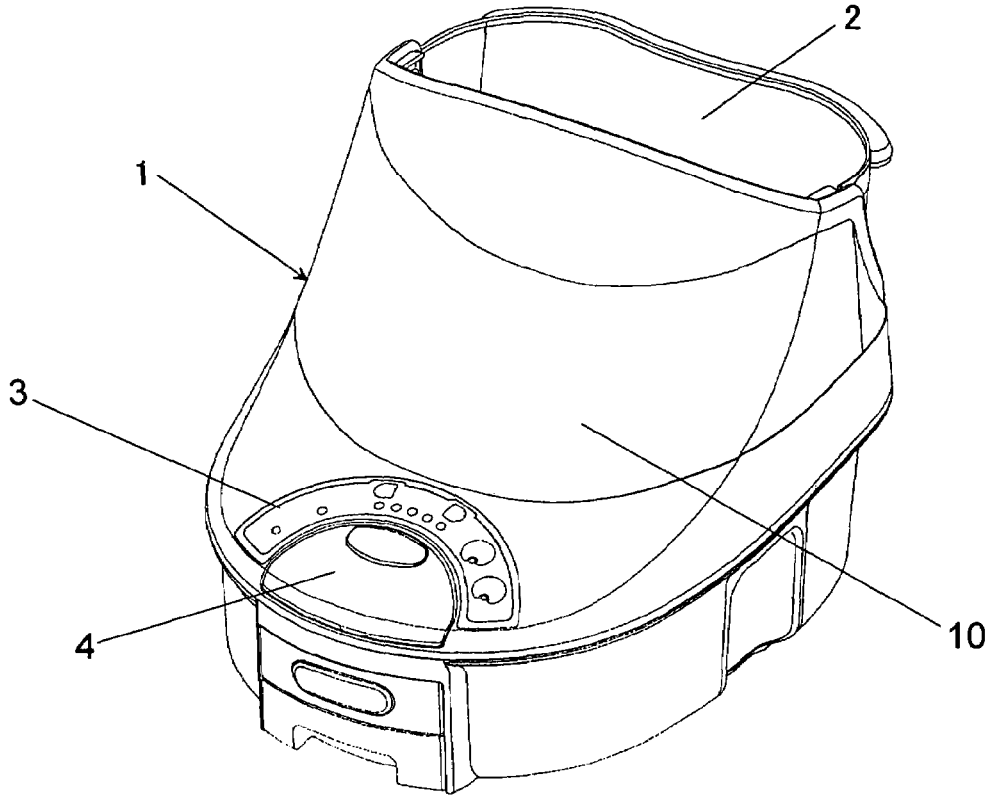
FIG. 1 is a perspective view of a foot bath apparatus according to a preferred embodiment of the present invention.

As shown in FIG. 1, this foot bath apparatus 1 is configured in a boot shape, in which both feet of a user can be inserted from a top opening 2. The numeral 3 designates an operation panel provided at the front side of the foot bath apparatus 1, at which a main power switch and buttons for setting bathing conditions are arranged. The numeral 4 designates a feed water tank detachably attached to a housing 10 of the foot bath apparatus.

Figure 2:
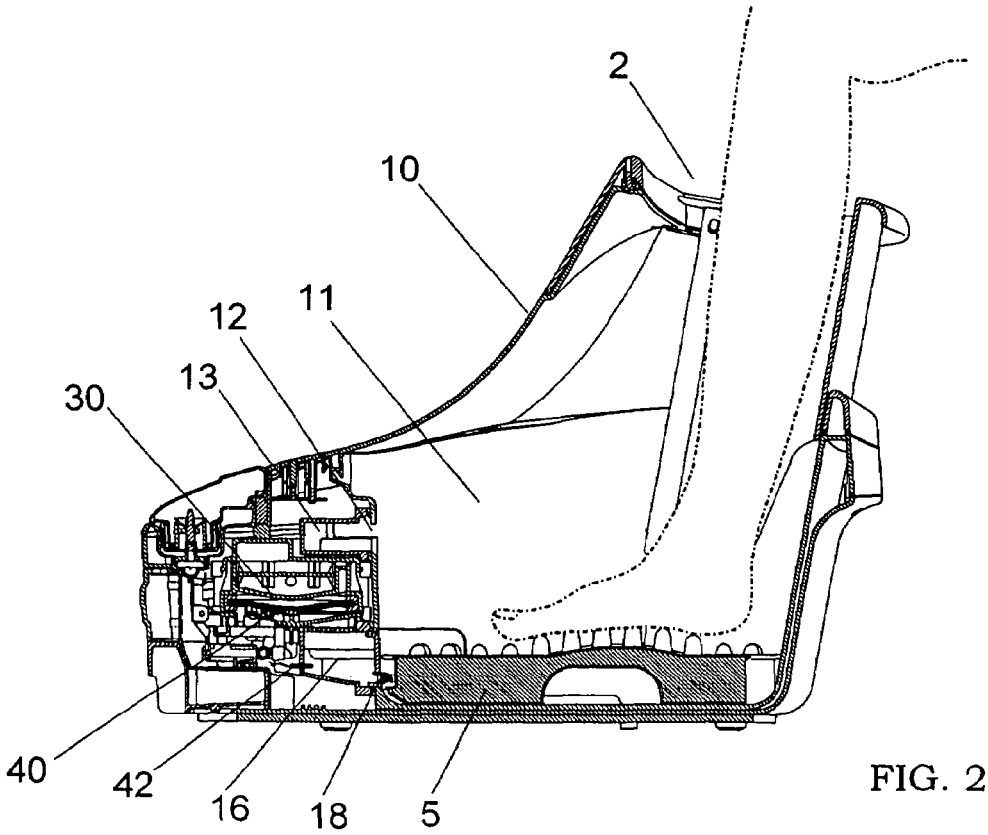
FIG. 2 is a cross-sectional view of the foot bath apparatus.

As shown in FIG. 2, this foot bath apparatus 1 is formed with the housing 10 having a foot bath room 11 therein, a built-in tank 30 for receiving water from the feed water tank 4 and storing a required amount of water, a heater 40 for heating water in the built-in tank 30 to generate heated water particles, i.e., steam, suction port 12 formed in an inner wall facing the foot bath room 11, air intake channel 13 connected to the suction port 12 to send the air in the foot bath room into a mixing room, the mixing room 16 for mixing the steam generated by the heater 40 with the air provided from the air intake channel 13, supply port 18 for supplying a resultant mixture of the steam and the air from the mixing room 16 into the foot bath room 11, and a footplate 5 disposed in the foot bath room 11. The housing 10 is formed such that the foot bath room 11 has a sufficient internal volume to accommodate the both feet of the user.

Figure 3:
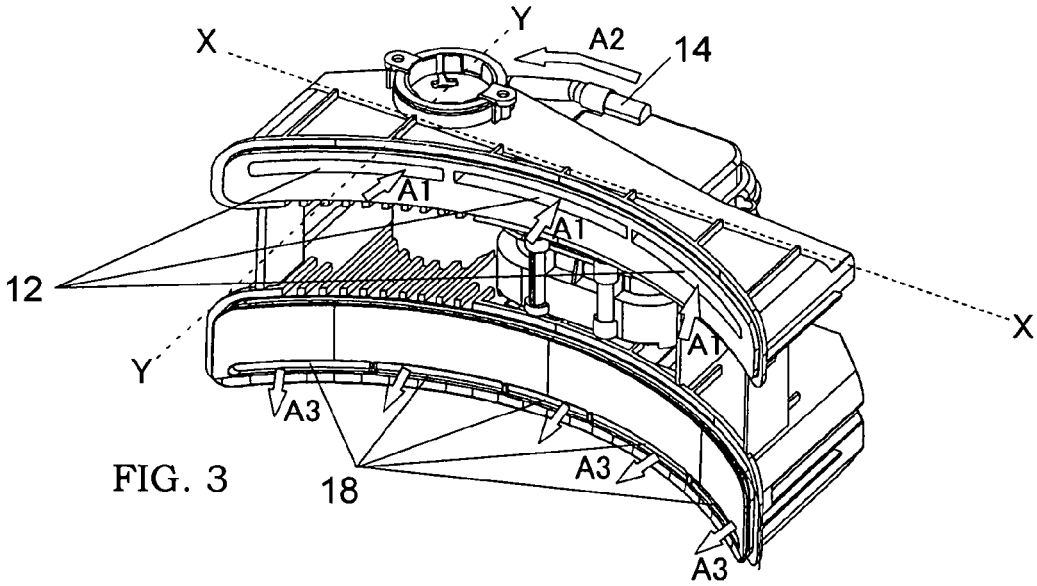
FIG. 3 is a partially perspective view of the foot bath apparatus.
Figure 4:
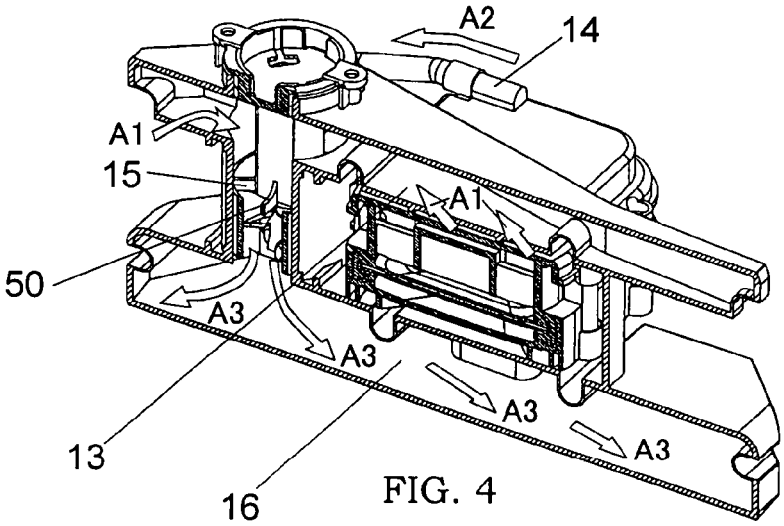
FIG. 4 is a partially perspective view with a cross section taken along the line X-X in FIG. 3.
Figure 5:
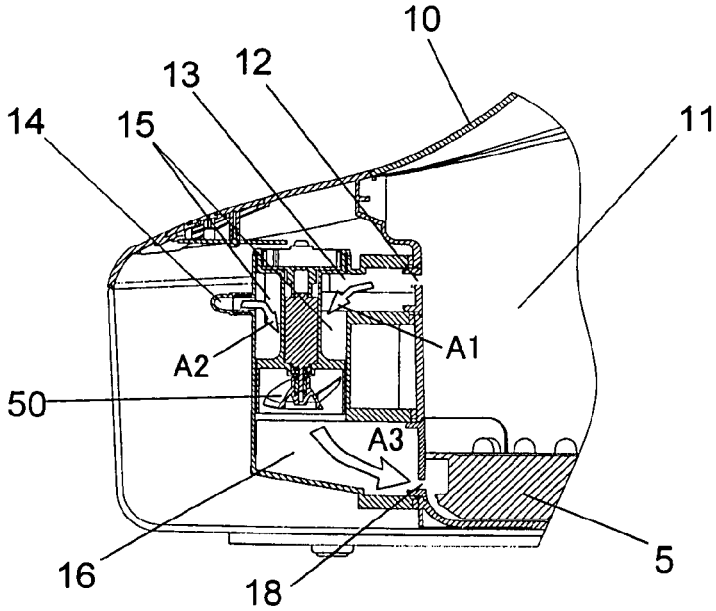
FIG. 5 is a cross-sectional view taken along the line Y-Y in FIG. 3.

Flows of the steam and the air in the foot bath apparatus of this embodiment are explained in more detail. As shown in FIGS. 3 to 5, the foot bath apparatus further comprises a steam intake channel 14 for sending the steam generated by the heater 40 to the mixing room 16, and a converging portion 15 for joining the steam intake channel 14 with the air intake channel 13, and a single fan 50 disposed in the converging portion 15 to simultaneously supply both of the air provided from the air intake channel 13 and the steam provided from the steam intake channel 14 into the mixing room 16.

Figure 6:
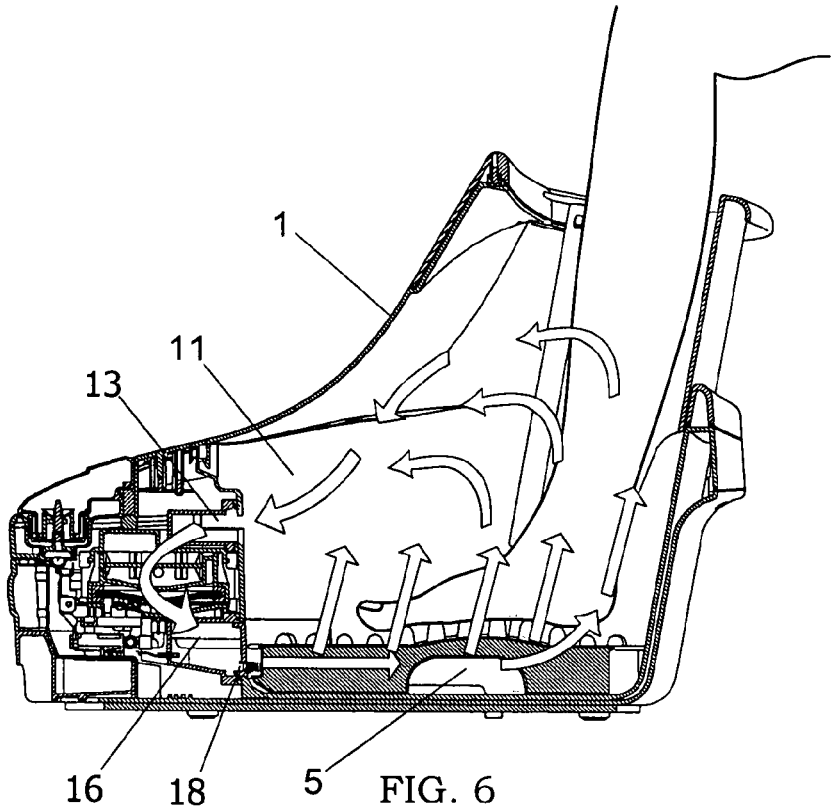
FIG. 6 is a cross-sectional view illustrating a circulation flow in the foot bath apparatus.

When the fan 50 disposed in the converging portion 15 is operated, the air in the foot bath room 11 is sucked into the air intake channel 13 through the suction port 12, as shown by the arrows A1 in FIG. 3, and at the same time the steam generated by the heater 40 is sucked into the steam intake channel 14, as shown by the arrow A2 in FIG. 3. As shown in FIGS. 4 and 5, the air provided from the air intake channel 13 joins at the converging portion 15 with the steam provided from the steam intake channel 14, and then both of them are ejected into the mixing room 16 by the fan 50. In the mixing room 16, the steam and the air are uniformly mixed by convention, and then a resultant mixture is supplied into the foot bath room 11 through the supply port 18, as shown by the arrows A3 in FIGS. 3 to 5. Thus, the air flows along a circulation path composed of foot bath room 11—air intake passage 13—mixing room 16—supply port 18—foot bath room 11. FIG. 6 shows a circulation flow generated in the foot bath apparatus during the bathing operation.

The temperature of the mixture to be supplied into the foot bath room 11 through the supply port 18 can be adjusted by changing a mixture ratio of the steam and the air. As the supply amount of the steam increases, it is possible to provide the mixture at a higher temperature. For example, the heater 40 can be controlled to obtain a desired amount of the steam to be supplied into the mixing room 16. Alternatively, the fan 50 may be controlled to obtain a desired amount of the air to be supplied into the mixing room 16. Furthermore, the supply amount of the air may be controlled by suitably designing a diameter of the suction port 12 or a length of the air intake channel 13. In FIG. 2, the numeral 42 designates a thermistor disposed to detect the temperature of the mixture. By controlling the heater 40 and/or the fan 50 in a feedback manner according to an output of the thermistor 42, it is possible to stably provide the warm bath effect to the user at the desired temperature.

In addition, it is preferred to monitor the interior temperature of the foot bath room 11 because it is very close to the temperature actually sensed by the user during the bathing operation. In this case, by controlling the heater 40 and/or the fan 50 in a feedback manner according to the monitored temperature information, it is possible to accurately control the temperature of the mixture so as to meet a desired bathing temperature and obtain a higher degree of satisfaction of the user. Moreover, since an abnormal temperature change accidentally caused in the foot bath room 11 can be quickly detected, the foot bath apparatus with higher safety can be provided.

As shown in FIG. 6, it is preferred that the supply port 18 is formed at a position ahead of the user's toes and slightly lower than the top surface of the footplate 5. There is no limitation with respect to the shape and size of the supply port 18. However, from the viewpoint of uniformly providing the mixture to the both feet of the user, it is preferred that the supply port 18 is configured in a laterally elongated slit. Alternatively, the supply port 18 may be formed by a plurality of laterally elongated slits, as shown in FIG. 3. In addition, when an open area of the supply port 18 is smaller than the cross sectional area of the mixing room 16, the supply port functions as a spray nozzle. Therefore, a more uniformly mixed state of the steam and the air can be achieved.

Figure 7B:
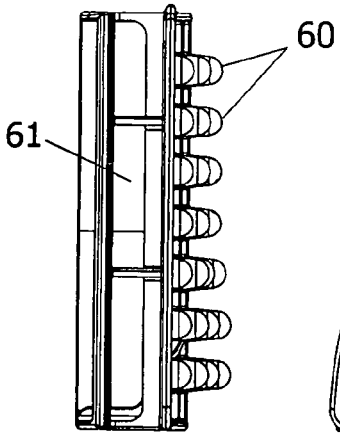
FIGS. 7A to 7C are partially plan (top, end and side) views of a footplate for the foot bath apparatus.
Figure 7A:
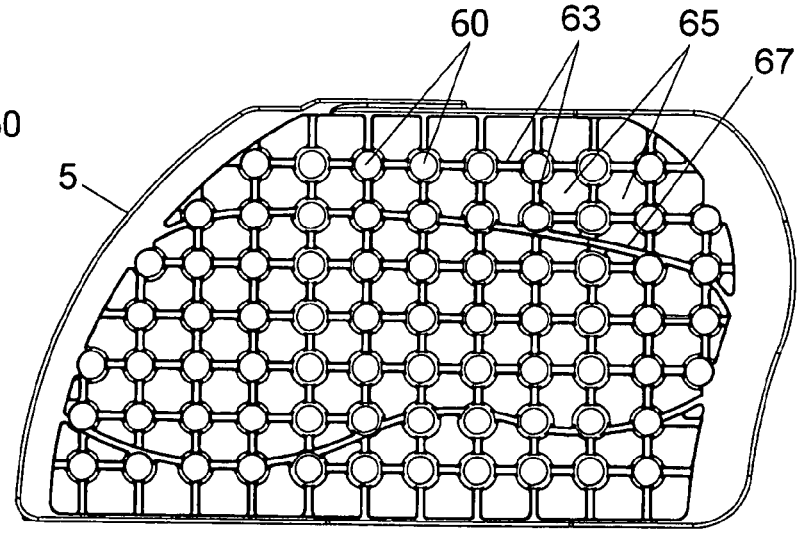
Figure 7C:
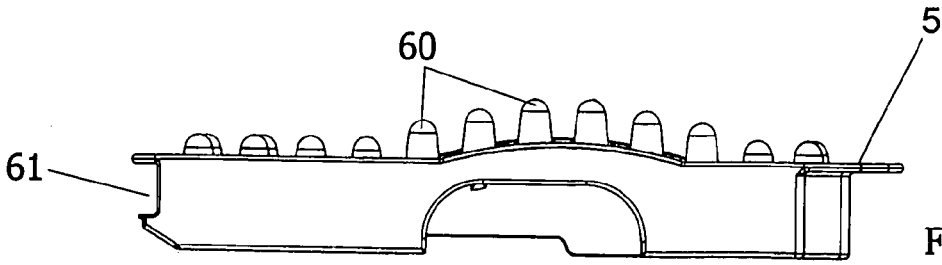

In this embodiment, as shown in FIG. 7A to 7C, the footplate 5 disposed in the foot bath room 11 to support the soles of the user's feet is of a hollow plate having an aperture 61 at its one side facing the supply port 18. A plurality of projections 60 having rounded ends are formed on a top surface of the footplate such that a contact area between the soles of the user's feet and the footplate becomes small, in other words, a contact area of the soles of the user's foot with the mixture of the steam and the air increases. As shown in FIG. 7A, the projections 60 are arranged in a matrix pattern such that adjacent projections in two orthogonal directions are equally spaced from each other. The numeral 63 designates a support rod extending between adjacent projections. Therefore, the mixture supplied into the footplate through the aperture 61 contacts the soles of the user's feet on the footplate through clearances 65 formed between adjacent support bars 63. At an arch of the user's foot, the projections 60 are designed to have larger heights so that the rounded ends of the projections uniformly contact the entire sole of the user's foot. Thereby, it is possible to provide the warm bath therapy effect by use of the mixture of the steam and the air as well as a massage effect brought by stimulating the soles of the user's feet by the projections. In FIG. 7A, the numeral 67 designates a marker for correctly guiding the foot-position of the user on the footplate 5.

Figure 8A:
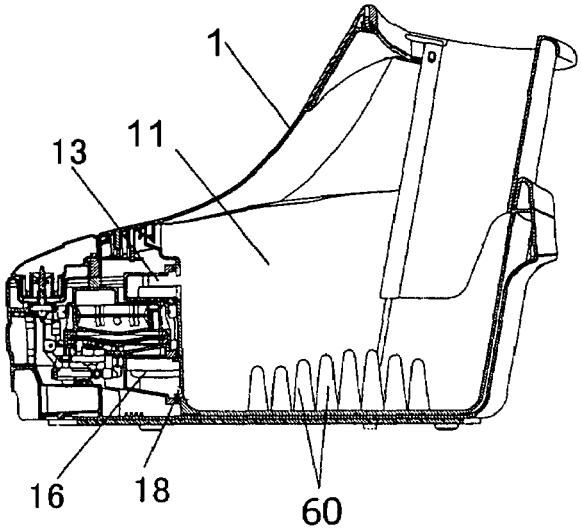
FIG. 8A is a cross-sectional view of a foot bath apparatus according to a modification of the above embodiment.
Figure 8B:
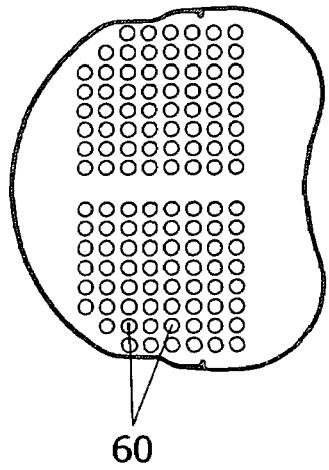
FIG. 8B is a plan view of a footplate of this foot bath apparatus.
Figure 9A:
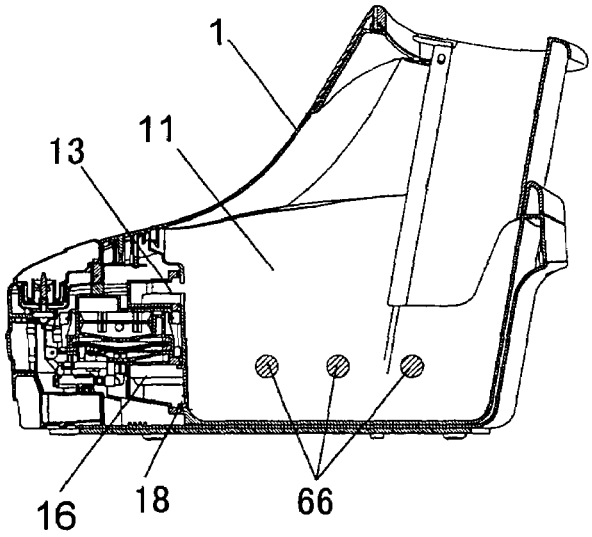
FIG. 9A is a cross-sectional view of a foot bath apparatus according to another modification of the above embodiment.
Figure 9B:
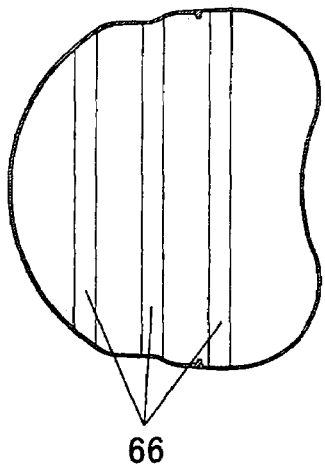
FIG. 9B is a plan view of a footplate of this foot bath apparatus.

There is no limitation with respect to the structure of the footplate 5. For example, as shown in FIGS. 8A and 8B, a plurality of projections 60 may be directly formed on a bottom of the foot bath room 11. In this case, the mixture is directly supplied into clearances between the adjacent projections 60. In addition, as shown in FIG. 9A and 9B, a plurality of horizontal bars 66 may be formed as foot supporting means in the foot bath room 11. In this case, the mixture is supplied to the soles of the user's feet through clearances between adjacent horizontal bars 66.

Figure 10:
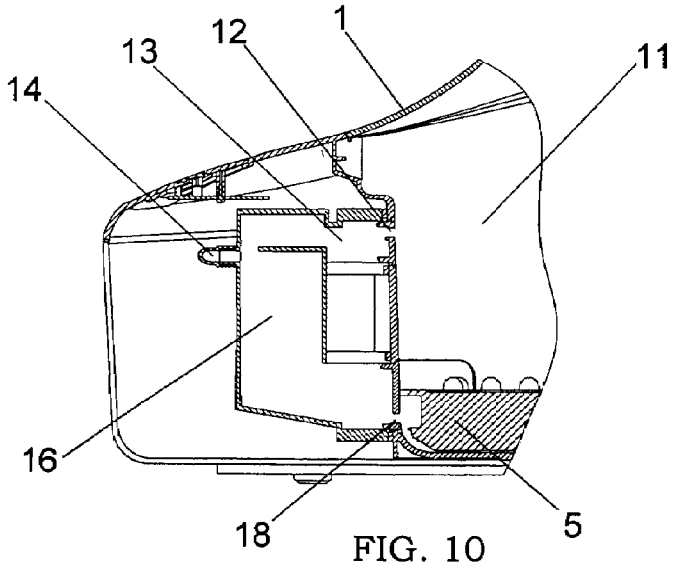
FIG. 10 is a partially cross-sectional view of a foot bath apparatus according to a further modification of the above embodiment.
Figure 11:
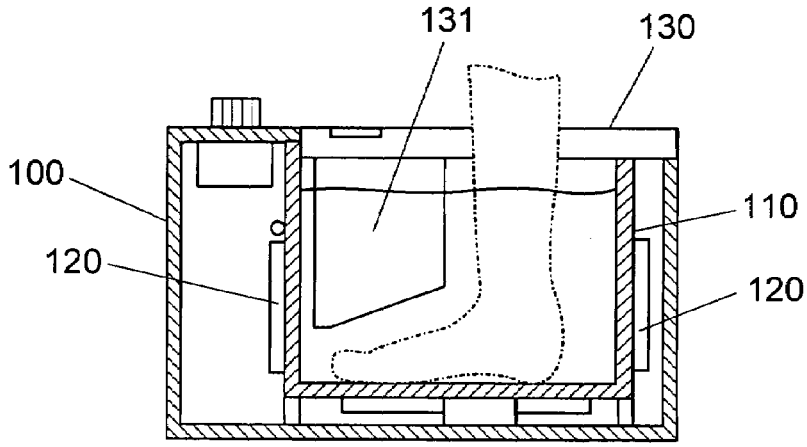
FIG. 11 (prior art)
FIG. 11 is a cross-sectional view of a conventional foot bath apparatus.
Figure 12:
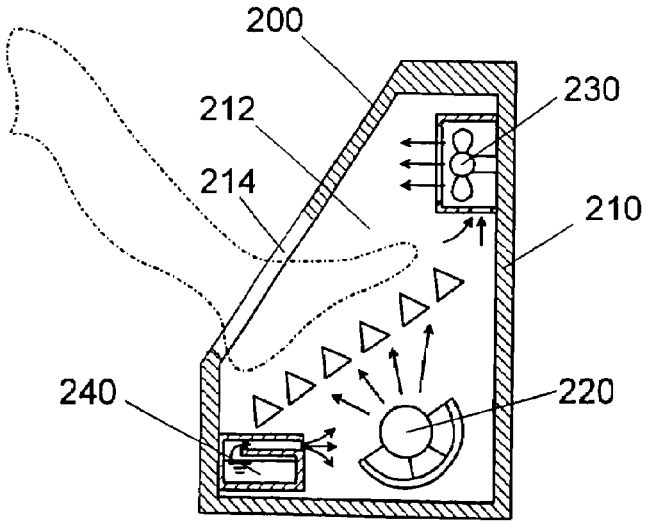
FIG. 12 (prior art)
FIG. 12 is a cross-sectional view of another conventional foot bath apparatus.

As a modification of this embodiment, as shown in FIG. 10, the fan 50 may be omitted. In this case, the air intake channel 13 and the steam intake channel 14 are directly connected to the mixing room 16. In addition, the air outside the foot bath apparatus may be supplied into the mixing room 16. In this case, the suction port 12 is formed in an outer surface of the housing 10. According to the Venturi effect, the outside air can be sucked into the air intake channel 13. If necessary, an auxiliary pump or fan may be disposed in the air intake channel 13 or the suction port 12.

The heated liquid particles generated by the heater 40 are not limited to steam obtained by vaporizing water. For example, bath agents with benefits of hot springs and Aloe Vera may be added to the tank 30. If necessary, additional tank and heater for a second liquid other than the liquid in the tank 30 may be placed in the foot bath apparatus. Moreover, in place of disposing the single fan 50 in the converging portion 15, a fan may be disposed in each of the air and steam intake channels (13, 14). Moreover, it is preferred to put a stirrer for enhancing the mixing of the air and the steam in the mixing room 16.

To keep clean the foot warm apparatus, it is preferred to carry out a cleaning operation at regular intervals. That is, when the heater 40 is operated under a condition that the tank 30 is empty, the air in the tank 30 is heated. Next, by rotating the fan 50, the air heated by the heater 40 is supplied into the foot bath room 11 through the mixing room 16. In this case, since a circulation flow of the heated air is generated in the foot bath apparatus, it is possible to efficiently dry the interior of the foot bath apparatus and prevent the propagation of contamination and fungus. In addition, to prevent overheat of the heater 40, it is preferred to detect a heater temperature and control electric power supplied to the heater according to the detected temperature. Alternatively, a PTC-type heater may be used.

From understood from the preferred embodiment described above, the foot bath apparatus of the present invention is characterized in that the heated liquid particles generated by the heater are previously mixed with the air in the mixing room, which is formed separately from the warm bath room, and subsequently the resultant mixture is supplied into the warm bath room. Therefore, the heated liquid particles of a high temperature generated by the heater are not directly supplied into the warm bath room. As a result, it is possible to safely provide an improved warm bath effect by use of a uniform mixture of the air and the heated liquid particles, and downsize the warm bath apparatus without causing the problem of burn injury. In addition, the formation of the suction port in the warm bath room to create the circulation flow is particularly effective to provide the warm bath apparatus excellent in energy-saving performance.

What is claimed is:

1. A warm bath apparatus comprising:

a housing having a warm bath room for accommodating a foot of a user;

a foot plate disposed in said warm bath room;

a tank for storing a liquid;

a heating device configured to heat said liquid to provide heated liquid particles;

a mixing room separately formed from said warm bath room in said housing to mix said heated liquid particles with air from said warm bath room;

an air intake channel positioned to supply the air into said mixing room;

a liquid-particle intake channel positioned to supply said heated liquid particles into said mixing room;

a converging portion joining said air intake channel and said liquid-particle intake channel and comprising a fan configured to supply the air from said air intake channel and said heated liquid particles from said liquid-particle intake channel to said mixing room so as to mix the air and said heated liquid particles; and a supply port for supplying a resultant mixture of said heated liquid particle and the air provided from said mixing room into said warm bath room, wherein said supply port is formed at a position ahead of a toe of the user's foot to be accommodated in said warm bath room and lower than a top surface of said footplate.

2. The warm bath apparatus as set forth in claim 1, wherein said resultant mixture is supplied to a sole of the foot accommodated in said warm bath room through said supply port.

3. The warm bath apparatus as set forth in claim 2, wherein said footplate has a plurality of apertures on a top surface of said footplate, through which said resultant mixture is supplied to the sole of the foot on said footplate.

4. The warm bath apparatus as set forth in claim 1, further comprising:

a thermistor disposed in said mixing room to detect the temperature of the mixture, wherein at least one said heating device and said fan is controlled in a feedback manner according to an output of the thermistor.

5. A warm bath apparatus comprising:

a warm bath room configured to accommodate a foot of a user;

a footplate disposed in said warm bath room;

a tank configured to store a liquid;

a vapor generator configured to generate a vapor from the liquid;

an air intake channel positioned to take in air from said warm bath room;

a vapor intake channel positioned to take in the vapor from said vapor generator;

a converging portion joining said air intake channel and said vapor intake channel;

a mixing room connected to said converging portion and configured to mix the vapor and the air from said converging portion, said mixing room being separately formed from said warm bath room in said housing; and a supply port for supplying a resultant mixture of the vapor and the air from said mixing room into said warm bath room, wherein said converging portion comprises a fan configured to supply the air from said air intake channel and the vapor from said vapor intake channel to said mixing room so as to mix the air and the vapor, and wherein said supply port is formed at a position ahead of a toe of the user's foot to be accommodated in said warm bath room and lower than a top surface of said footplate.

6. The warm bath apparatus as set forth in claim 5, further comprising a suction device configured to suck the air in said warm bath room into said air intake channel.

7. The warm bath apparatus as set forth in claim 5, wherein the resultant mixture is supplied to a sole of the foot accommodated in said warm bath room through said supply port.

8. The warm bath apparatus as set forth in claim 7, wherein said footplate has a plurality of apertures on a top surface of said footplate, through which the resultant mixture is supplied to the sole of the foot on said footplate.

* * * * *